US006755913B1

(12) United States Patent
Kobayashi et al.

(10) Patent No.: US 6,755,913 B1
(45) Date of Patent: Jun. 29, 2004

(54) MULTI-COLOR CHANGE DEVICE WITH CONDUCTIVE COATING MATERIAL FOR ELECTROSTATIC COATING

(75) Inventors: Shigeru Kobayashi, Chiba (JP); Hidetaka Tsukamoto, Kameoka (JP); Nobuo Ikeda, Tokyo (JP)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/890,027

(22) PCT Filed: Feb. 15, 2000

(86) PCT No.: PCT/US00/03926

§ 371 (c)(1),
(2), (4) Date: Jul. 24, 2001

(87) PCT Pub. No.: WO00/47333

PCT Pub. Date: Aug. 17, 2000

(51) Int. Cl.[7] ..... B05B 5/025

(52) U.S. Cl. ..... 118/620; 118/621; 118/323; 427/483; 427/595; 427/421; 239/695; 239/305; 239/397

(58) Field of Search ..... 118/620

(56) References Cited

U.S. PATENT DOCUMENTS 3,674,207 A 7/1972 Carbonetti, Jr. et al.
4,232,055 A 11/1980 Shaffer
4,616,782 A * 10/1986 Marietta et al. ..... 239/752
4,785,760 A * 11/1988 Tholome ..... 118/323
4,864,966 A 9/1989 Anderson et al.
5,152,466 A * 10/1992 Matushita et al. ..... 239/690
5,288,525 A * 2/1994 Diana ..... 427/475
5,549,755 A 8/1996 Milovich et al.
5,989,344 A * 11/1999 Platsch ..... 118/684

FOREIGN PATENT DOCUMENTS

GB 2149323 A 6/1985
WO WO 97/24189 7/1997

* cited by examiner

*Primary Examiner*—Richard Crispino
*Assistant Examiner*—Michelle Acevedo Lazor
(74) *Attorney, Agent, or Firm*—Calfee, Halter & Griswold, LLP

(57) ABSTRACT

In a color changing apparatus for multiple color electrostatic coating of conductive coating material, a pipe joint (a) provided to be movable and an electrostatic spray gun connected to the pipe joint (a) through a pipeline are provided. A plurality of coating material supply circulation circuits, including a liquid tank, a pump and a pipe joint (b) disengageably engageable with the pipe joint (a) are provided. The liquid tank, the pump and the pipe joint (b) are connected through a pipeline. The pipe joint (a) and the pipe joint (b) in the plurality of coating material supply circulation circuits can be selectively engaged.

10 Claims, 2 Drawing Sheets

MULTI-COLOR CHANGE DEVICE WITH CONDUCTIVE COATING MATERIAL FOR ELECTROSTATIC COATING

RELATED APPLICATIONS

This application is a national phase entry under 35 U.S.C. §371 of PCT application number PCT/US00/03926, filed Feb. 15, 2000, which designated the U.S., which claims priority under 35 U.S.C. §119, to Japanese application serial number 11-076290, filed Feb. 15, 1999, both applications of which are fully incorporated by reference herein.

FIELD OF THE INVENTION

The present invention relates to a color changing apparatus for multiple color electrostatic coating which is performed with a conductive coating material such as an aqueous coating material using an electrostatic coating spray gun supplied with a high voltage. More specifically, the present invention relates to a color changing apparatus for multiple color electrostatic coating of conductive coating material, for realizing easy maintenance of a system other than the system which is being used for coating without being influenced by a high voltage applied and for facilitating color changing.

BACKGROUND OF THE INVENTION

An electrostatic coating method is a technique for applying a high voltage (generally, 80 to 125 kV) to a corona pin provided in a coating material spray gun and electrostatically charging the coating material which is sprayed from the spray gun to a high potential so as to apply the coating material on a surface of a subject of coating which is grounded. Accordingly, when a conductive coating material based on a conductive solvent such as water, methanol or the like is used, a conductive path is formed by the conductive coating material from the spray gun to a coating tank through a coating material supply line. The coating material supply system including the coating material tank and a pump needs to be insulated from the ground since otherwise the high voltage is grounded through the coating material supply line and thus cannot be applied to the corona pin provided on the spray gun.

In such an apparatus, high potential electrostatic charges are accumulated in all the devices from the spray gun and the coating material supply system. It is very dangerous if the operator inadvertently contacts a device in the coating material supply system having such a large discharge energy accumulated therein. Therefore, the coating material cannot even be supplemented to the coating material tank while the apparatus is in operation. In the case where a color changing apparatus for multiple color coating has a structure in which a plurality of coating material supply systems respectively for multiple colors are directly connected to one another through a switching valve or the like, electrostatic charges are accumulated, through a switching valve, even in a coating material supply system for a color other than the color which is in use. Thus, the degree of danger is increased, and the coating material cannot be supplemented even to a coating material tank for a color other than the color which is in use.

As a method for alleviating these problems regarding color changing for multiple color coating, technologies described. In Japanese Laid-Open Publication Nos. 4-200663 and 4-200664 are proposed. The technology disclosed in Japanese Laid-Open Publication Nos. 4-200663 will be first described. An electrostatic coating apparatus for conductive coating material which is used for applying a conductive coating material by an electrostatic coating machine supplied with a high voltage is disclosed. A plurality of pumps are provided in an electrically insulating state, the plurality of pumps having a coating material inflow opening and a coating material outflow opening through which a required amount of conductive coating material introduced through the coating material inflow opening is pushed out by pressure at a prescribed flow rate in accordance with the coating material discharge amount of the electrostatic coating machine. Detachably connected to the coating material inflow opening of each of the pumps is a coating material supply pipe, which is connected to a respective color changing valve apparatus including a cleaning air supply valve and a cleaning liquid supply valve. The coating material outflow opening of each pump is connected to a switching valve for communicating the coating material outflow opening to an outflow path on the electrostatic coating machine side or to an outflow path on the exhaust liquid tank side. Each exhaust liquid pipe connected to the exhaust liquid tank is detachably connected to the outflow path on the exhaust liquid tank side.

The technology disclosed in Japanese Laid-Open Publication Nos. 4-200664 will be described. An electrostatic coating apparatus for conductive coating material which is used for coating a conductive coating material by an electrostatic coating machine supplied with a high voltage is disclosed. A plurality of coating material pressure-supply tanks for pushing out a required amount of conductive coatings material stored therein by air pressure and supplying a constant amount of the conductive coating material to the electrostatic coating machine, and a cleaning liquid pressure-supply tank for pushing out a required amount of cleaning liquid stored therein by air pressure and supplying the cleaning liquid to the electrostatic coating machine are provided in an electrically insulating manner. The coating material pressure-supply tanks and the cleaning liquid pressure-supply tank are connected to the respective color chancing valves provided in parallel to a manifold communicated to the electrostatic coating machine. The coating material pressure-supply tanks are each provided with a coating material supplement opening, and the cleaning liquid pressure-supply tank is provided with a cleaning liquid supplement opening. The coating material supplement opening is detachably connected to a supply pipe for supplying a conductive coating material of a corresponding color, and the cleaning liquid supplement opening is detachably connected to a cleaning liquid supply pipe.

The above-described conventional technologies, i.e., the technologies disclosed in Japanese Laid-Open Publication Nos. 4-200663 and 4-200664 have the following problems. The technology disclosed in Japanese Laid-Open Publication No. 4-200663 has the problems that the circuit is relatively complicated and accordingly the operation is relatively troublesome; and each coating material supply system requires two separate mechanisms of a coating material supply system and an exhausted liquid system. The technology further has the following problem. Although not clear from the publication or the figures, a conductive path is formed, through the conductive coating material, in a plurality of coating material supply systems (i.e., pumps, coating material tanks and the like) respectively connected to color clanging valves ($CV_1$ through $CV_3$) of color changing valve devices (9A, 9B, 9C) while the systems are in use (i.e., connected to the electrostatic coating machine). Therefore, none of the color coating materials can be supplemented due to the possible danger of high potentials. Therefore, before supplementing the coating materials, the coating operation needs to be stopped so as to shield the high voltage.

The technology disclosed in Japanese Laid-Open Publication No. 4-200664 also has the following problem. A conductive path is formed, through the conductive coating material or the cleaning liquid, even in a plurality of coating material pressure-supply systems (1A, 2B, 2C) and the cleaning liquid pressure-supply tank (3) while coating is performed. Therefore, none of the color coating materials can be supplemented due to the possible danger of high potentials. Therefore, before supplementing the coating materials, the coating operation needs to be stopped so as to shield the high voltage.

SUMMARY OF THE INVENTION

The present invention made in light of the above-described problems has an objective of providing a color changing apparatus for multiple color electrostatic coating of conductive coating material, which has a relatively simple structure and realizes a relatively simple operation; which separates coating material supply systems other than the system for the color which is being used for coating from a circuit charged with a high voltage, so as to avoid any influence of the high voltage, so that works such as coating material supplement and maintenance can be done while the coating is performed; and which realizes easy color changing.

In order to solve the above-described problems, the present invention provides the following method. In a color changing apparatus for multiple color electrostatic coating of conductive coating material, a pipe joint provided to be movable on a guide rail and an electrostatic spray gun connected to the pipe joint a through a pipeline are provided. A plurality of coating material supply circulation circuits, including a liquid tank, a pump and a pipe joint b disengageably engageable with the pipe joint a are provided. The liquid tank, the pump and the pipe joint b are connected through a pipeline. The pipe joint a and the pipe joint b in the plurality of coating material supply circulation circuits can be selectively disengaged.

BRIEF DESCRIPTION OF THE DRAWINGS

The invention may take physical form in certain parts and arrangements of parts, preferred embodiments and a method of which will be described in detail in this specification and illustrated in the accompanying drawings which form a part hereof, and wherein.

DESCRIPTION OF THE REFERENCE NUMERALS

1 . . . guide rail; 2 . . . pipe joint a; 3 . . . actuator, 4 . . . electrostatic spray gun; 11 liquid tank; 12 . . . pump; 13 . . . pipe joint b; 14 . . . actuator; 16 . . . pressure adjusting valve; 22 . . . subject of coating.

DETAILED DESCRIPTION OF THE PREFERRED EMBODIMENTS

Figure 1:
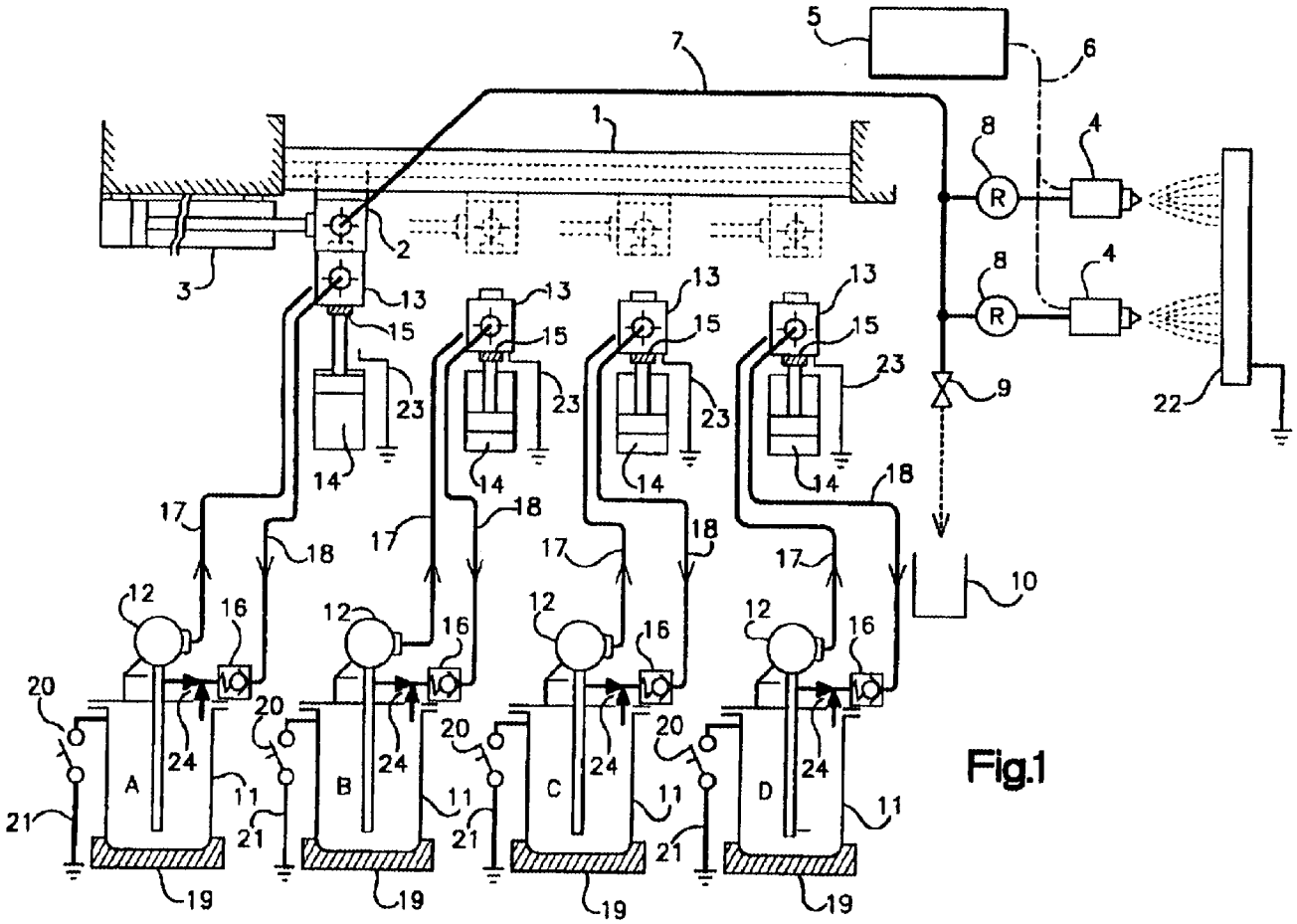
FIG. 1 is a schematic front view illustrating an exemplary color changing apparatus for multiple color coating according to the present invention.
Figure 2:
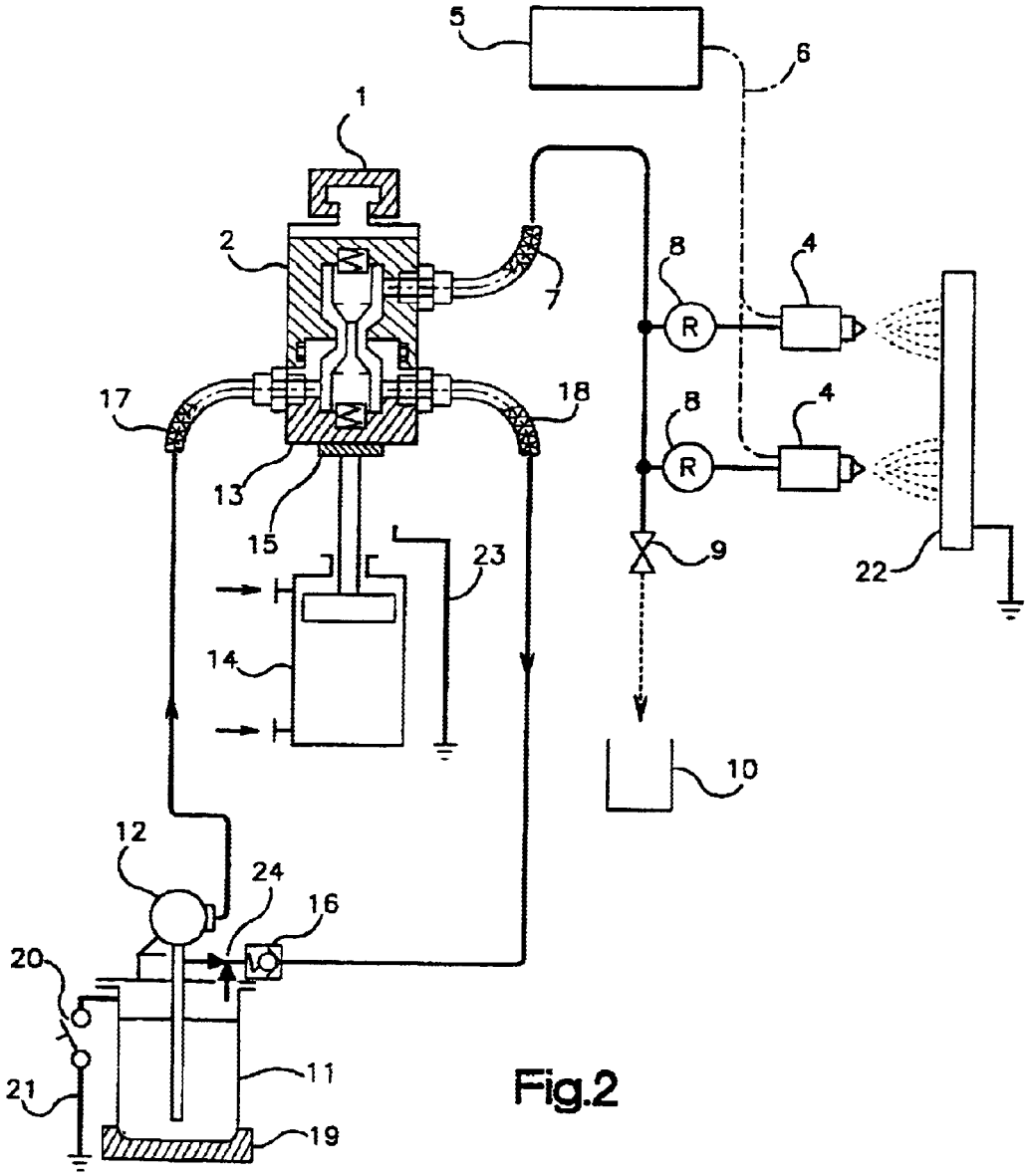
FIG. 2 is a schematic side view of FIG. 1.

Hereinafter, embodiments of the present invention will be described with reference to FIGS. 1 and 2. According to the present invention, a plurality of coating material supply circulation circuits, i.e., the plurality of coating material supply circulation circuits including a liquid tank, a pump and a pipe joint b which are connected through a pipeline can be started, stopped and otherwise operated. A pipe joint a provided to be movable on a guide rail and an electrostatic spray gun are connected to each other via a one-way pipeline. Accordingly, the coating material supply circulation circuit associated with the pipe joint b engaged with the pipe joint a is influenced by a high voltage applied to the electrostatic spray gun through the conductive coating material. The other coating material supply circulation circuits are not influenced by the high voltage since the conductive path is completely disconnected between the pipe joint a and the pipe join b. Therefore, even while coating is performed, the coating material supply circulation circuits which are not used can be supplemented with a coating material, even a highly conductive coating material, or subjected to maintenance.

Before changing colors, one of the liquid tanks (for example, tank D) can be filled with a cleaning liquid, and the pipe joint b in the circulation circuit of the liquid tank D, and the pipe joint a can be connected to each other while color A is replaced with color B. Thus, the flow system from the pipe joint a to the electrostatic spray gun connected to the pipe joint a through the pipeline is grounded and cleaned by the cleaning liquid. Accordingly, a color changing operation can be performed easily without color mixture.

Hereinafter, examples of the color changing apparatus for multiple color electrostatic coating of conductive coating material according to the present invention will be described by way of drawings. FIG. 1 is a schematic front view illustrating a structure of an exemplary color changing apparatus for multiple color electrostatic coating of conductive coating material according to the present invention; and FIG. 2 is a schematic side view of FIG. 1.

In the figures, reference numeral 1 represents a guide rail which can be fixed on a support or a wall; reference numeral 2 represents a movable coupling or pipe joint a provided to be movable on the guide rail 1. The movable coupling, or pipe joint a 2 is movable on the guide rail 1 by a drive, such as an actuator 3. In this example, a mechanical drive in the form of a hydraulic operable cylinder is used as the actuator 3, but the drive or actuator can be of other known systems such as an electric system. Reference numeral 4 represents a spray device, such as an electrostatic spray gun having a valve mechanism inside. The spray device, or electrostatic spray gun 4, is connected to a high voltage power supply 5 through a cable 6. A high voltage (80 to 125 kV) is applied to a corona pin in the electrostatic spray gun 4 to supply an electrostatic charge to coating material discharged from the spray gun, as desired. The pipe joint a 2 and the electrostatic spray gun 4 are connected to each other through a supply line, or pipeline, 7. When connecting the pipeline 7 and the pipe joint a 2, the pipe joint a 2 moves. It is required they are connected so as not to disturb the movement. Providing a flexible hose or the like may be a simple way to realize this.

In this example, two electrostatic spray guns 4 are provided. The number of the electrostatic spray guns 4 is not limited to two and can be any number in accordance with the conditions of the shape, size and the like of the subject of coating. When a plurality of electrostatic spray guns 4 are provided, each of the electrostatic spray guns 4 is preferably provided with a flow rate adjusting valve 8 in order to allow the balance of the amounts of the coating material from the electrostatic spray guns 4 to be adjusted. Reference numeral 9 represents a dump valve; and reference numeral 10 represents an exhaust liquid receptacle. The dump valve 9 and the exhaust liquid receptacle 10 are used for cleaning the inside of the pipeline 7. In the case where the exhaust liquid is recovered in an external recovering container (drum or the like) although not shown, a dump shuttle, or voltage block, may be provided to completely electrically insulate the external recovering container from the systems.

Reference numeral 11 represents a coating material source or liquid tank for the coating material (one of them is used for the cleaning liquid). A plurality of coating material sources, or liquid tanks 11, are provided. Four such sources are indicated in the drawings with reference numerals 11 and representing colors A, B, C and D. Reference numeral 12 represents a pump located above the liquid tank 11. Reference numeral 13 represents a coating material coupling, or pipe joint, b. Either one of the pipe joint b 13 and the pipe joint a 2 is male and the other is female so that they are disengageably engaged, or selectively engaged, with each other. The pipe joint a 2 and the pipe joint b 13 are provided with an internal check valve mechanism for allowing the liquid to flow only when the pipe joint a 2 and the pipe joint b 13 are engaged with each other and automatically closing the liquid path when the pipe joint a 2 and the pipe joint b 13 are disengaged from each other. In one embodiment of the invention, the pipe joint b 13 is connected to the actuator 14 for performing engagement and disengagement by an electrically insulating material 15 which is interposed therebetween. In this example, a hydraulic cylinder mechanism is used as the actuator 14. Of course, an engagement drive, such as a hydraulic cylinder (not shown) can be connected to movable coupling, or pipe joint a 2 to selectively, or disengageably, engage with one of the pipe joints b 13. Alternatively, and also not shown, the movable pipe joint a 2 can selectively engage with one of the pipe joints b 13 only when properly positioned, and disengage when not so positioned thereby sealing both pipe joints a 2, b, 13. The pipe joint b 13 is automatically grounded by a ground %%ire at the lowest point where the pipe joint b 13 is disengaged from the pipe joint a 2. Reference numeral 16 represents a pressure adjusting valve, and reference numeral 24 represents a circulation valve.

These devices, i.e., the liquid tank 11, the pump 12, the pipe joint b 13, the pressure adjusting valve 16, and the circulation valve 24 are connected through supply lines, or pipelines 17 and 18 to form the coating material supply circulation circuit. That is, the conductive liquid coating material stored in the liquid tank 11 is pumped up by the pump 12 and flows from the coating material supply line, or pipeline, 17 to the pipe joint b 13, and then flow through the pipeline 18, the pressure adjusting valve 16 and the circulation valve 24. Then, the conductive liquid coating material returns to the suction side of the pump 12. A part of the conductive liquid coating material returns to the liquid tank 11. During this procedure, the pressure in the coating material supply circulation circuit is maintained at a prescribed level by the pressure adjusting valve 16.

When connecting the pipelines 17 and 18 and the pipe joint b 11, the pipe joint b 13 moves up and down in the illustrated embodiment. It is required they are connected so as not to disturb the movement. Providing a flexible hose or the like may be a simple way to realize this. Reference numeral 19 represents an insulating material for electrically insulating the liquid tank 11. The coating material supply circulation circuit may undesirably have residual high potential electrostatic charges even after the pipe joint a 2 and the pipe joint b 13 are separated from each other. The liquid tank 11 is connected to the relay 20 and a grounding circuit 21 for grounding and releasing the electrostatic charges remaining in the coating material supply circulation circuit at the time of maintenance. The relay 20 and the grounding circuit 21 cooperate with the ground wire 23 to form a double safe mechanism. A voltage block is thereby formed which electrically isolates the liquid tank from ground while that liquid tank is being used in a conductive coating operation and isolates the liquid tank from the spray gun while not being used to transmit coating material for a coating operation. Reference numeral 22 represents a grounded subject of coating.

In this example, the apparatus includes three coating material supply circulation circuits including the liquid tank 11, the pump 12, the pipe joint b 13, the pressure adjusting valve 16 and the circulation valve 24 which are connected through the pipelines 17 and 18, for convenience. The number of the supply circulation circuits is not limited to three and can be any number in accordance with the number of colors required.

Next, the function of the color changing apparatus for electrostatic coating will be described. First the liquid tanks 11 are respectively filled with conductive coating materials A, B and C of different colors. The tank D is assumed to be filled with a cleaning liquid for convenience, in order to wash the coating material flow path when the colors are changed. Herein, an example in which coating material A shown in FIG. 1 is applied will be described for convenience. Coating materials of other colors are applied in a similar manner. The actuator 3 is operated to position the pipe joint a 2 so as to be engaged with the pipe joint b 13 of the coating material supply circulation circuit for an intended color (color A of FIG. 1). Then, the actuator 14 is operated to engage the pipe joint a 2 with the pipe joint b 13. Then, the high voltage power supply 5 is started and the corona pin of the electrostatic spray gun 4 is supplied with a high voltage. At this point, the dump valve 9 is closed.

When the pump 12 for color A is started, the conductive liquid coating material A stored in the liquid tank 11 is pumped up by the pump 12 and circulates in the coating material supply circulation circuit, which passes from the pipeline 17 to the pipe joint b 13, then flows through the pipeline 18, the pressure adjusting valve 16 and the circulation valve 24, and returns to the suction side of the pump 12 or the liquid tank 11. Conductive liquid coating material A maintained at the prescribed pressure also flows from the pipe joint b 13 through the pipe joint a 2, the pipeline 7 and the flow rate adjusting valve 8 to reach the electrostatic spray gun 4. When the valve mechanism incorporated in the electrostatic spray gun 4 is opened, coating material A is sprayed from the nozzle of the electrostatic spray gun 4 and applied on the surface of the target of coating which is grounded.

The high pressure applied to the electrostatic spray gun 4 influences all the devices in the coating material supply circulation circuit in the system of coating material A, in which the conductive path is formed through the conductive coating material A. Accordingly, all the devices in which the conductive path is formed need to be maintained in an insulating state. Although not shown, the devices need to be enclosed by a protection fence or the like so as to prevent the operator from inadvertently contacting the devices in FIG. 11 in order to maintain all the devices in an insulating state, the entire system is maintained in an insulating state by the relay 20 of the grounding circuit 21 which is opened, separation of the pipe joint b 13 from the ground wire 23 as a result of elevation of the actuator 14, and the insulating material 19 provided in the liquid tank 11. While coating is performed with coating material A, the supply circulation circuits for coating material B, coating material C and the cleaning liquid D other than coating material A are completely separated from the high voltage conductive path at the pipe joint b 13 and also are grounded by the grounding wire 23, the closed relay 20 and the grounding circuit 21. Thus, these supply circulation circuits other than the circuit for coating material A are not influenced by the high voltage.

Next, the process of color chancing will be described. First, in order to avoid mixing of a color already used and a color to be used, the pipe joint a, the pipeline 7, the flow rate adjusting valve 8 and the electrostatic spray gun 4 need to be cleaned. Since the cleaning operation does not need application of a high voltage, the high voltage power supply is disconnected before the cleaning operation starts. Then, the actuator 14 is operated to disengage the pipe joint a 2 from the pipe joint b 13. Since the pipe joint a 2 and pipe joint b 13 are provided with a check valve mechanism for preventing liquid leakage, the liquid does not leak.

Next, the actuator 3 is operated to position the pipe joint a 2 so as to be engaged with the pipe joint b 13 of the cleaning liquid supply circulation circuit connected to the tank D filled with the cleaning liquid. Then, the actuator 14 of the cleaning liquid supply circulation circuit D is operated to engage the pipe joint b 13 with the pipe joint a 2. When the dump valve 9 is opened to start the pump 12, coating material A remaining in the pipeline 7 is pushed out to the exhaust liquid receptacle 10. Thus, the pipeline 7 is cleaned. When the cleaning of the pipeline 7 is finished, the dump valve 9 is closed. When the valve mechanism incorporated in the electrostatic spray gun 4 is opened, the flow rate adjusting valve 8 and the electrostatic spray gun 4 are cleaned. After the cleaning of the flow rate adjusting valve 8 and the electrostatic spray gun 4 is finished, the valve mechanism incorporated in the electrostatic spray gun 4 is closed. Thus, the cleaning operation is completed.

Next, the pipe joint a 2 engaged with the supply circulation circuit for the cleaning liquid D is separated from the pipe joint b 13. The pipe joint a 2 is moved to be engaged with the pipe joint b 13 of the coating material supply circulation circuit for coating material B, and the pump 12 for coating material B is started to supply coating material B to the electrostatic spray gun 4. Thus, the color changing from coating material A to coating material B is completed. A high voltage is applied to the electrostatic spray gun 4 to open the valve mechanism inside the electrostatic spray gun 4. Thus, coating material B is applied to the subject 22 of coating.

By structuring the coating material supply system to be a circulation circuit having the pipe joint b 13, the pipelines can be engaged or disengaged at one pipe join, which is significantly simpler than in the conventional structures. The circulation circuits, other than the circulation circuit which is selected and being used (i.e., the circulation circuit having the pipe joint b 13 which is engaged with the pipe joint a 2), are completely separated from the high voltage power supply at the pipe joint b 13 and grounded. Accordingly, these circulation circuits can be supplemented with the coating material or subjected to maintenance even while the apparatus is in operation without being influenced by the high voltage. Since electrostatic charges may undesirably remain from before the separation at the pipe joint b 13, the relay 20 needs to be closed to release the remaining electrostatic charges through the grounding circuit 21 before the maintenance is started.

As described above, a color changing apparatus for multiple color electrostatic coating of conductive coating material according to the present invention provides relatively simpler structure and operation than the prior art apparatuses. The apparatus is structured so that the coating material color supply systems other than the system for the color which is in use are completely separated from the circuit charged with a high voltage and thus are not influenced by the high voltage. Thus, eaten while the coating is performed, supplementing of the coating material and maintenance can be done. The color changing operation is facilitated.

We claim:

1. A color changing apparatus for multiple color coating of conductive coating material, comprising a first pipe joint movable on a guide rail and an electrostatic spray device connected to said first pipe joint through a pipeline; a plurality of coating material supply circulation circuits are provided, each including a respective liquid tank for holding a coating material source, a pump and a movable second pipe joint that can be selectively engaged with said first pipe joint, the liquid tank and the pump and said second pipe joint being connected through a pipeline; wherein when said first pipe joint is selectively engaged with one of said plurality of second pipe joints said first pipe joint and the others of said plurality of second pipe joint in the plurality of coating material supply circulation circuits are disengaged from each other, wherein at least one of said movable second pipe joint is electrically grounded when disengaged from said first pipe joint and electrical ungrounded when engaged with said first pipe joint.

2. The apparatus of claim 1 wherein at least one of said liquid tanks is for holding a source of electrically conductive, coating material, said at least one liquid tank is selectively isolated from ground.

3. The apparatus of claim 2 further comprising a power supply for applying an electric charge to said electrically conductive coating material discharged from said spray device and a voltage block which electrically isolates said liquid tank which is transmitting the electrically conductive coating material to said spray device from electrical ground.

4. The apparatus of claim 3 wherein said voltage block electrically isolates from said spray device said liquid tanks which are not transmitting coating material to said spray device.

5. The apparatus of claim 1 further comprising a relay for each of said supply circulation circuits, wherein each of the liquid tanks is selectively electrically isolated from ground and selectively grounded.

6. The apparatus of claim 1 further comprising a drive for moving the guide rail.

7. The apparatus of claim 6 wherein the drive comprises a hydraulic operable cylinder.

8. The apparatus of claim 1 further comprising a check valve for each of said pipe joints, such that coating material flow is allowed when said first pipe joint is connected with a respective one of said plurality of second pipe joints and coating material flow is automatically stopped when the respective connected pipe joints are disconnected.

9. The apparatus of claim 1 wherein each supply circulation circuit further comprises a pressure adjusting valve and circulation valve.

10. The apparatus of claim 1 wherein each said movable second pipe joint moves in a direction that is generally transverse a direction of movement of said first pipe joint to engage therewith and disengage therefrom.

* * * * *